United States Patent [19]

Martucci

[11] 4,356,588

[45] Nov. 2, 1982

[54] DRIPLESS CEILING PAINT ROLLER AND PAINT METERING PAN

[76] Inventor: Frank C. Martucci, 360 Tom Hunter Rd., Fort Lee, N.J. 07024

[21] Appl. No.: 293,278

[22] Filed: Aug. 17, 1981

Related U.S. Application Data

[62] Division of Ser. No. 140,758, Apr. 16, 1980, Pat. No. 4,337,002.

[51] Int. Cl.[3] ..... B44D 3/12

[52] U.S. Cl. ..... 15/257.06

[58] Field of Search ..... 15/257.06, 257.05, 230.11; 401/118, 121

[56] References Cited

U.S. PATENT DOCUMENTS 2,778,050 1/1957 Meinhardt ..... 15/257.06 X 3,602,939 9/1971 Schoenholz ..... 15/257.06

*Primary Examiner*—Edward L. Roberts

*Attorney, Agent, or Firm*—Peter C. Michalos; Constantine A. Michalos

[57] ABSTRACT

A roller with a spray guard comprising a roller arm, a roller rotatably mounted on one end of the arm, a handle member connected to an opposite end of the arm, and a spray guard pivotally mounted to the arm one end, extending at least the axial length of the roller. The arm is of a length sufficient to permit the free pivoting of the guard whereby the guard pivotally hangs below the roller when in use. The guard is preferably planar in shape and, with forward movement of the roller across a surface to be painted, the guard pivots toward the surface with a trailing edge thereof so that it automatically is positioned in the best location to receive spray from the roller. A paint metering pan is also disclosed which utilizes a screen or grill structure biased upwardly and away from pain in a container which is moved downwardly by abutment with the roller to permit a selected amount of paint to come in contact with the roller.

3 Claims, 8 Drawing Figures

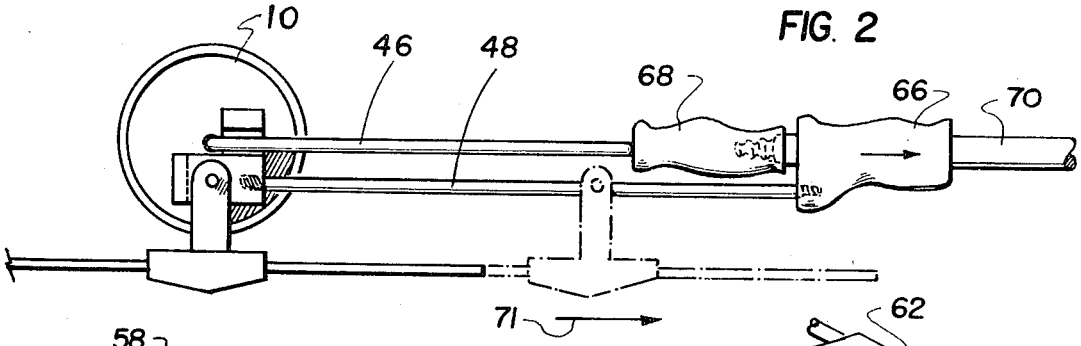
FIG. 2
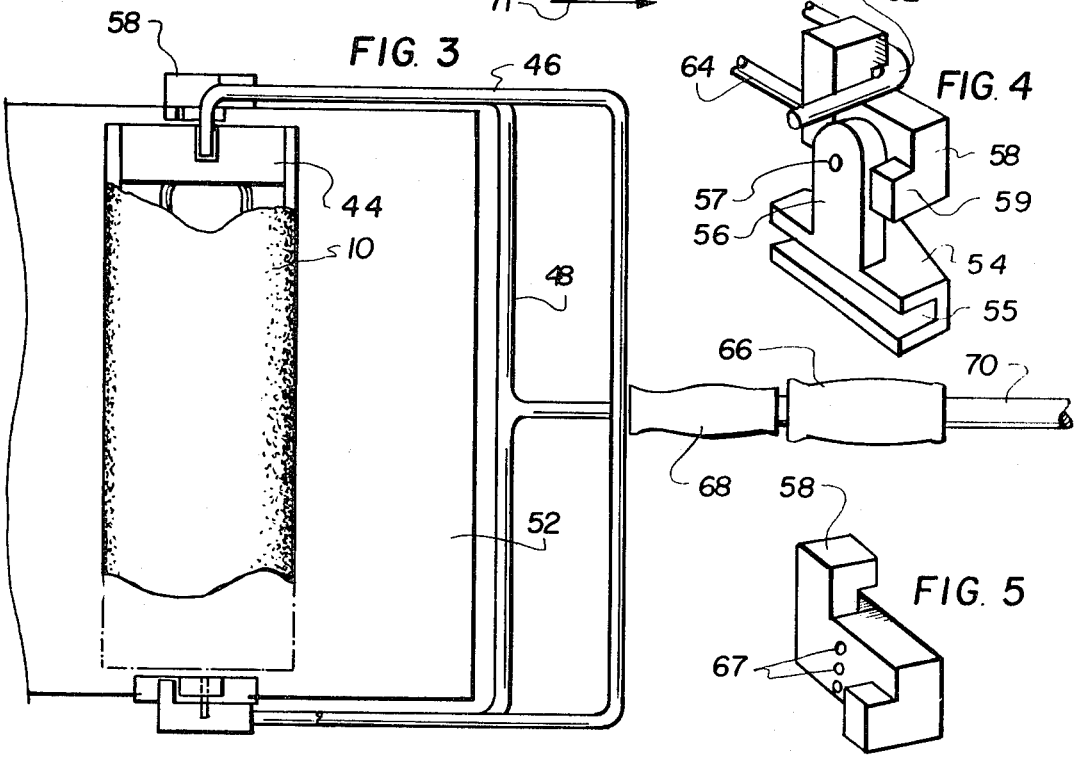
FIG. 3
FIG. 4
FIG. 5
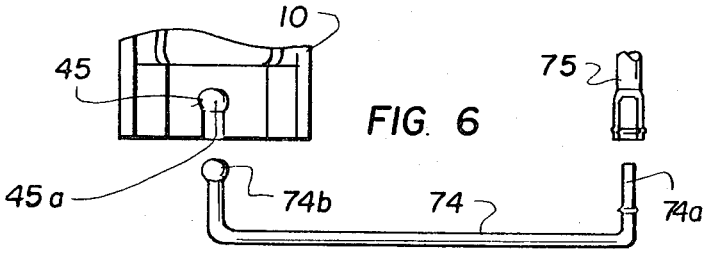
FIG. 6
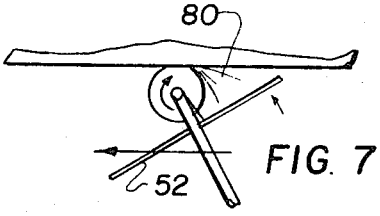
FIG. 7
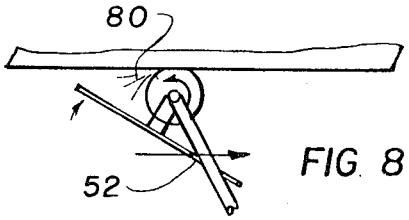
FIG. 8

DRIPLESS CEILING PAINT ROLLER AND PAINT METERING PAN

This is a division of application Ser. No. 140,758 filed Apr. 16, 1980, now U.S. Pat. No. 4,337,002.

FIELD AND BACKGROUND OF THE INVENTION

The present invention relates in general to painting devices and, in particular, to a new and useful dripless ceiling paint roller and a new and useful metering pan for providing small and selective quantities of paint to the roller.

In painting ceilings of rooms that are furnished or have floors that must be protected, a large amount of time and effort is utilized in covering the furniture and floors with suitably provided dropcloths and the like. Even with such care, furniture and floors are often splattered with paint. In addition, the painter himself is continually sprayed by paint released from a roller, for example, used to paint a ceiling.

SUMMARY OF THE INVENTION

The present invention is drawn to a convenient solution for the foregoing problems and provides professional painters or homeowners with a paint spray or drip catching guard which can be used in conjunction with a roller. The guard may be retractable to permit easy charging of the roller with paint. A metering paint pan is also provided so that only selected and desired quantities of paint are applied to the roller.

The invention thus eliminates the need for large and bulky dropcloths or the like and also avoids the time wasted in spreading such dropcloths. Only a relatively narrow, for example, three foot wide runner might be necessary to be placed along the walls of a room having a ceiling to be painted.

Accordingly, an object of the present invention is to provide a roller with spray guard comprising a roller arm, a roller rotatably mounted on one end of the arm, a handle member connected to an opposite end of the arm, and a spray guard pivotally mounted to the arm one end, extending at least the axial length of the roller with the arm being of a length sufficient to permit free pivoting of the guard whereby the guard pivotally hangs below the roller.

A further object of the present invention is to provide such a roller with spray guard wherein the guard is planar in shape and mounted for movement on the roller when the roller is in use to paint a surface so that the guard pivots toward the surface with a trailing edge thereof when the roller is moved in a painting direction. The guard is thus positioned at exactly the proper location for catching a maximum of spray from the roller when in use.

A further object of the present invention is to provide such a roller with spray guard wherein the guard is mounted on a retracting apparatus connected to the roller arm for retracting the guard from the vicinity of the roller to permit charging of the roller with paint.

Another object of the present invention is to provide a metering pan for a paint roller comprising an open container for receiving paint, the container having a deep trough section, a paint grill member having a grill section overlying said container and said grill member to bias said grill member upwardly and way from a surface of the paint in the container whereby a roller can be rolled across the top of said grill member to move it into the paint a selected distance.

A still further object of the present invention is to provide a roller with spray guard and a metering pan which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

BRIEF DESCRIPTION OF THE DRAWINGS

In the drawings:

FIG. 2 is a side elevational view of another embodiment of the roller and spray guard according to the invention;

FIG. 3 is a top plan view, with portions cut away for clarity, of the embodiment of the invention shown in FIG. 2;

FIG. 4 is a partial detailed perspective view of the embodiment shown in FIG. 2;

FIG. 5 is a view similar to FIG. 4 of a detail thereof;

FIG. 6 is a partial top perspective view, with portions cut away, of an alternate embodiment of the invention;

FIG. 7 is a diagrammatic side elevational view of the roller with guard in operation, and FIG. 8 is a view similar to FIG. 7 showing the roller and guard moving in an opposite direction.

DESCRIPTION OF THE PREFERRED EMBODIMENTS

Figure 1:
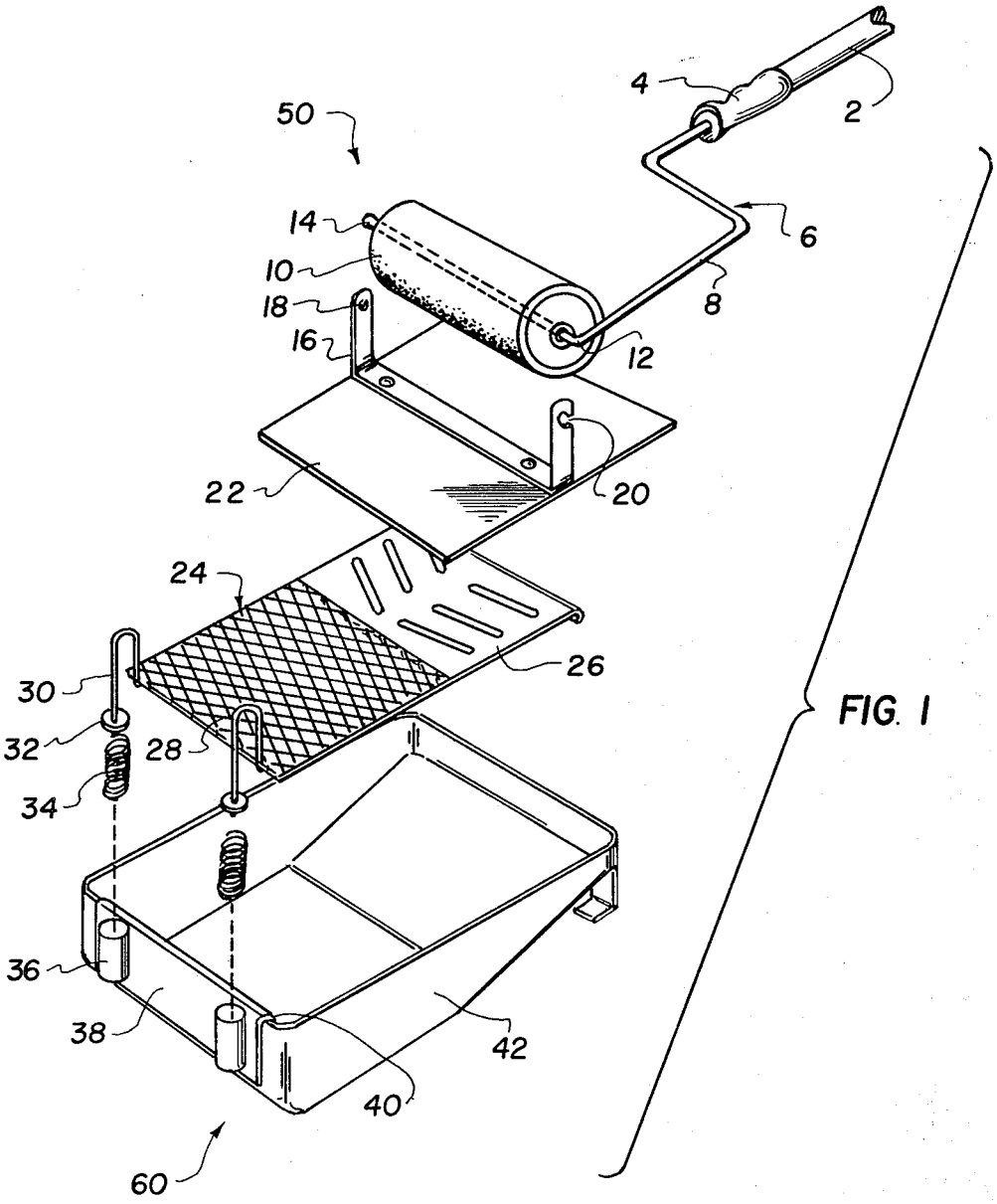
FIG. 1 is an exploded perspective view of a roller with spray guard and metering pan according to the invention.

Turning to the drawings in particular, the invention embodied therein in FIG. 1 comprises a roller 10 rotatably mounted on an arm generally designated 6 having a handle member 4 adapted to be held to use the roller 10 for operation or adapted to receive an extension such as a broom handle 2 for permitting easy operation of the roller to paint a ceiling or the like. The arm 6 has one end rotatably carrying the roller 10 between a large diameter end 14 and a curved end 12 of the arm 6. Arm 6 also includes a section 8 which is of a length sufficient to accommodate and permit the pivotal movement of a paint drip and spray guard 22. The support member 16 is centrally connected to the paint guard 22 by rivets or the like and has two opposite legs which include apertures or openings for accepting the arm ends 14 and 12. One leg includes a blind opening or closed opening 18 for accepting the end 14 and the other leg includes an open opening 20 which can be hooked around the bend 12. The guard 22 can thereby easily be connected and disconnected from arm 6 for permitting the use of the guard 22 and also for the permitting the charging of roller 10 within a paint pan or container 42. The roller and guard thus form a roller with spray guard generally designated 50.

The metering pan generally designated 60 comprises a grill member 24 having a grill or screen support portion 28 and a paint squeezing portion 26. The member 24 is shaped and sized to be positionable over and in the paint can or container 42 which has a deep portion or section underlying the grill portion 28 and a shallow or inclined section underlying the paint squeezing portion or section 26. The container 42 is provided with a plate 38 having a curved top edge 40 adapted to be connected over and securely hold the plate 38 to one side of the container 42. Plate 38 carries two blind or closed cylinder members 36 which are of a diameter sufficient to contain springs 34 and washers 34 which are connected to two support wires 30 which are in turn connected at one end of the grill portion 28. In operation, the wire supports 30 with washers 32 and springs 34 within cylinders 36 act as two biasing means near the corner of one edge of portion 28 for holding the grill member 24 upwardly and out of paint contained in the container 42. When charging a roller 10 in the paint, the roller is pressed against the grill member 24, which is rigid or flexible, to move the grill member 24 against the bias of spring 34 into engagement with a level of paint in the container 42. The paint then moves through the spaces in the grill member 28 and comes into contact with the roller 10. At this point, the roller 10 is moved across the paint squeezing portion 26 to provide an even distribution of paint on the roller. Portion 26 has a bent edge to hook over an edge of the container 42, to act as a fulcrum for the motion of member 24 on spring 34.

This apparatus thus prevents the drowning of rollers in deep amounts of paint normally contained in paid containers 42 and thus further reduces the amount of spray and dripping generated by a paint roller. This also prevents paint from contaminating the guard guides and mechanism. The metering pan should thus be used for the roller having the inventive guard feature.

It is noted that the guard also protects the roller arm and handle from splatter and spray.

Turning now to FIGS. 2 and 3, an alternate embodiment of the invention is shown. In this embodiment a roller pin is mounted through hubs 44 to the ends 62 of a lower arm 46 which is connected in turn to a roller handle 68. As with the embodiment of FIG. 1, the roller handle 68 may be used alone or with an extension arm or handle 70. A slide handle 66 is snugly slideably mounted on the extension 70 and is connected to a slide arm 48. Slide handle 66 can thus be positioned and locked at any point on extension 70. Other lock means can be provided for this purpose, such as latches or the like. Slide arm 48 has ends 64 which are connected, for example, threaded into slide pulls 58 which are shown in greater detail in FIGS. 4 and 5. A swivel mount 54 is connected through a swivel post 56 to slide pulls 58. Mount 54 has a slot 55 for receiving one side of the spray guard shown at 52. Pivot post 56 is connected through a pin 57 to one of a plurality of holes 67. A suitable hole 67 is chosen depending on the diameter of roller 10 to prevent contact between the surface of roller 10 and the guard 52. Each puller 58 includes a stop 59 for preventing forward or clockwise rotation, as seen in FIG. 2, of the guard 52 on its mounts 54. This permits a painter to tip the roller 10 downwardly to engage a paint containing container. Before dipping the roller 10 in such a container, however, the operator pulls back on handle 66 retracting the guard 52 and its mounts in a direction of arrows 71 to bring it into its position shown in FIG. 2. The parallel sections of roller arm 46 are of sufficient length to permit full retraction of the guard 52 and expose the roller 10 so that it can be charged with paint.

In embodiment of the invention shown in FIGS. 2 and 3, a new roller pin or clean roller pin may be connected to the arm 46 by simply pulling the parallel sections of arm 56 away from each other and disengaging the end 62 of the arm sections from the hub portions 44 of roller 10. In FIG. 6 an alternate form of the invention is shown where a side section 74 of an arm for a roller 10 is provided with two ends 74A and 74B. End 74B has an enlarged circular portion which fits or snaps into a hub 45 having a suitably provided opening 45A for carrying the roller 10. Only the one such removable section 74 need be provided for engaging and disengaging a roller 10 from the inventive guard structure.

Turning to FIGS. 7 and 8, the operating characteristic of the invention is shown when it is used in operation. When a painter moves the roller assembly to the left, as shown in FIG. 7, air resistance causes the guard 52 to rotate in counter clockwise direction so that its trailing edge in the direction of movement of the roller moves upwardly toward the surface of the ceiling. In this position, the guard is exactly disposed to catch spray 80 coming off of the trailing side of the roller. The opposite direction is shown in FIG. 8 which, due to wind resistance of the guard 52, causes guard 52 to move in a clockwise direction and again be placed in a proper position to the spray 80, which now comes off the opposite side of the roller. This characteristic is due to the planar shape of the guard 52 and experiments have shown that this arrangement causes an exact positioning, depending on the speed of movement of the roller and direction, for catching a maximum of spray and preventing substantially all of the spray from striking unwanted and unprotected surfaces.

Whereas specific embodiments of the invention have been shown and described in detail, it is understood that the invention can be embodied otherwise without departing from the principles thereof.

What is claimed is:

1. A metering grid for metering paint onto a paint roller from a tray having a shallow portion and a deep portion for containing a level of paint, the grid comprising:

a grid member having a first part for overlaying the deep portion, and a second part for overlaying the shallow portion;

said second part having a bent edge hooked over an upper edge of said tray shallow portion; and biasing means connected to said grid member and engagable with the tray for biasing said grid member up and out of the level of paint in the tray, so that a roller is charged with paint, at a proper amount, by pressing the roller against the grid member to move the grid member and roller into the paint against the bias of said biasing means;

said biasing means comprising a pair of springs connected to an edge of said first part of said grid member opposite said second part bent edge and near opposite corners of said first part edge.

2. A paint roller tray comprising a container having a shallow portion and a deep portion for containing a level of paint, a grid member having a grid portion over said deep portion, and a paint roller squeezing portion over said shallow portion, and biasing means for biasing said grid member out of the level of paint in said container whereby a roller is charged with a proper amount of paint by pressing the roller against the grid member to move it a selected distance into the level of paint in said container, said biasing means comprising a cylinder having an open end and closed bottom end connected to said container, a rod connected to one end of said grid member extendable into said cylinder, a stop connected to said rod, and a spring engaged on said stop adapted for being received in said cylinder.

3. A paint roller tray according to claim 2 wherein said cylinder is carried on a bracket engaged with an edge of said container.

* * * * *